US005295443A

United States Patent [19]

Bängtsson et al.

[11] Patent Number: 5,295,443

[45] Date of Patent: Mar. 22, 1994

[54] ARRANGEMENT FOR TILTING A RAILBOUND VEHICLE IN TRACK CURVES

[75] Inventors: Hans Bängtsson, Enköping; Nils G. Nilstam; Rickard Persson, both of Västerås, Sweden

[73] Assignee: Asea Brown Boveri AB, Västerås, Sweden

[21] Appl. No.: 778,115

[22] PCT Filed: Jun. 29, 1990

[86] PCT No.: PCT/SE90/00467

§ 371 Date: Dec. 10, 1991

§ 102(e) Date: Dec. 10, 1991

[87] PCT Pub. No.: WO91/00815

PCT Pub. Date: Jan. 24, 1991

[30] Foreign Application Priority Data

Jul. 13, 1989 [SE] Sweden ..... 8902526

[51] Int. Cl.[5] ..... B61F 5/02

[52] U.S. Cl. ..... 105/199.2

[58] Field of Search ..... 105/453, 199.1, 199.2

[56] References Cited

U.S. PATENT DOCUMENTS

| | | | |
|---|---|---|---|
| 3,854,420 | 12/1974 | Hinnen et al. | 105/199.2 |
| 3,902,691 | 9/1975 | Ott | 105/199.2 |
| 4,069,767 | 1/1978 | Glaze | 105/199.2 |
| 4,113,111 | 9/1978 | Theurer et al. | 105/199.1 |
| 4,324,187 | 4/1982 | Sambo | 105/199.2 |
| 4,363,277 | 12/1982 | Martin et al. | 105/199.2 |
| 4,440,093 | 4/1984 | Kakehi et al. | 105/199.2 |
| 4,665,835 | 5/1987 | Mohacsi et al. | 105/199.2 |
| 4,715,289 | 12/1987 | Okamoto et al. | 105/199.2 |

FOREIGN PATENT DOCUMENTS

| | | | |
|---|---|---|---|
| 2129716 | 12/1971 | Fed. Rep. of Germany | 105/199.2 |
| 2135633 | 2/1973 | Fed. Rep. of Germany | 105/199.2 |

*Primary Examiner*—Mark T. Le

*Attorney, Agent, or Firm*—Watson, Cole, Grindle & Watson

[57] ABSTRACT

The invention relates to an arrangement on a railbound vehicle with hydraulic cylinders (14*a*, 14*b*, 15*a*, 15*b*) for tilting the car body in track curves. The arrangement is characterized in that the hydraulic cylinders are arranged mutually communicating and that the tilting of the car body is adapted to be controlled by a servo function comprising one servo valve (13) per vehicle.

5 Claims, 8 Drawing Sheets

ARRANGEMENT FOR TILTING A RAILBOUND VEHICLE IN TRACK CURVES

TECHNICAL FIELD

The present invention relates to an arrangement for a railbound vehicle with hydraulic cylinders for tilting of the car body in track curves.

BACKGROUND ART

In vehicles with an active hydraulic tilting of the car body, the tilting is usually controlled by two servo functions, one per bogie, each function comprising a servo valve, hydraulic cylinder(s) and some form of mechanical bolster. Such multi-function systems involve the risk that the two (or the different) servo functions may start acting against each other via the relatively torsionally rigid car body, which gives diagonal unloading and loading stresses on the wheels of the two bogies. This, in turn, may entail a risk of derailment and this eventuality thus requires an extensive monitoring system. (See further FIG. 1 and the associated text.)

From, for example, Swedish patent specification 381 012, a similar arrangement is already known, in which the distance between the car body and the different bogies on both sides of the car body is measured for the purpose of obtaining an output quantity, which constitutes a measure of the rotation of the different bogies in relation to the car body. The intention is to obtain a fast indication of the vehicle's entry into and exit out of a track curve. This signal together with, for example, the lateral acceleration signal, may be utilized as control signal(s) to the tilting system of the vehicle. The intention is to develop a tilting system which provides a comfortable journey for the passengers without any significant influence of lateral acceleration, and to make possible greater train speeds. It is also desired to avoid sensitivity to any unevenness of the track.

SUMMARY OF THE INVENTION

The invention relates to a solution to the above problems and other problems associated therewith. The invention is characterized in that the hydraulic cylinders mutually communicate and that the tilting of the car body is adapted to be controlled by a servo function comprising one servo valve per vehicle.

By controlling the tilting movement of the two (or the different) bogies from one single servo valve, i.e. in parallel and with the hydraulic cylinders freely mutually communicating, the hydraulic forces of the two bogies are prevented from counteracting each other in case of a system fault.

From, for example, the publication Querneigesystem für Schnellzugwagen by Von Rolf Wipf, Sonderdruck aus "Technische Rundschau", No. 22/1976, a control system is known in which a feedback control system controls a main valve, which in turn controls the working cylinders at the two bogies of a car. However, in this device the working cylinders are not directly affected by the main valve since, in addition, hydraulic valves (FIG. 3) are arranged at the respective bogie, which means that the two working cylinders do not communicate at each point of time.

A laterally sensing acceleration normally constitutes a control signal to the tilting system. Preferably, the lateral acceleration is measured in the front bogie of the train unit. The measured signal is thereafter transmitted to all tilting cars in the train in order to constitute a control signal to the tilting system of the respective car.

However, using only laterally sensing acceleration, it is difficult at a sufficiently early stage to obtain information as to when a track curve occurs under a railway vehicle with a tilting car body. At the same time as the lateral acceleration increases/decreases in a track curve, normally also the superelevation increases/decreases. It is previously known that the rate of change of the superelevation can be measured with speed gyro, and also that the twist between car body and bogies can be measured. By controlling the tilting movement of the two bogies in parallel with only one valve and such that the hydraulic cylinders of the two bogies communicate, the corresponding quantities are formed internally in the two bogies. Quantities occur as the difference between the rotation ($\phi_1$ and $\phi_2$, respectively) of the mechanical bolster (which follows the car body) of the bogies towards the bogies (which follow the rail), i.e. $\Delta\phi=\phi_1-\phi_2$. This signal is thus an indication of a transition curve and is used to speed up the time within which a reference value signal for car body tilt is available.

The turning angle is measured with an angular transducer, for example an electromechanical transducer, or, alternatively, with gyro or some other angular sensor.

In a further preferred embodiment, it is possible to distinguish a transition curve from a track fault by forming the correlation between the time rate of change of the acceleration and the time or space rate of change of the superelevation. By the correlation, a great signal-to-noise ratio is imparted to this signal. (See further below in this respect.)

BRIEF DESCRIPTION OF THE DRAWINGS

The invention is exemplified in the accompanying drawings, wherein.

DESCRIPTION OF THE PREFERRED EMBODIMENTS

Figure 1:
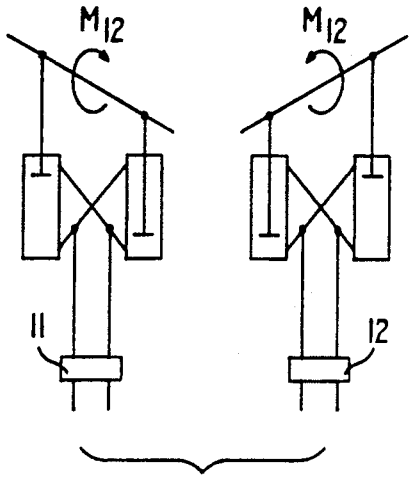
FIG. 1 PRIOR ART
FIG. 1 shows the prior art.

FIG. 1 shows elements of risk in the case of system faults in servo systems for different bogies associated with a vehicle, each one provided with a separate servo valve 11, 12. It is seen here how the torques arisen, $M_{11}$ and $M_{12}$, counteract each other, resulting in wheel unload.

Figure 2:
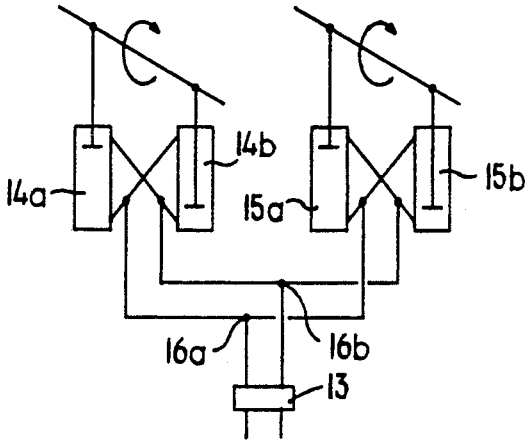
FIG. 2 shows a single-valve device according to the invention.

In FIG. 2 the two left-hand hydraulic cylinders 14*a*, 14*b* may be regarded as being the cylinders located at a first bogie of a railway vehicle for tilting the car body when the two cylinders are working in opposite directions, while the two right-hand hydraulic cylinders 15*a*, 15*b* may be regarded as the cylinders at a second bogie of the vehicle, also for effecting tilting movements of the car body in the same way. As can be concluded from the figure, the lower working spaces of the left-hand cylinders 14*a*, 15*a* of the respective first and second bogies are interconnected, while these lower working spaces are also interconnected to the upper working spaces of the right-hand cylinders 14*b*, 15*b* of the respective first and second bogies, these interconnections being symbolized by the conduits connected to point 16*a* of FIG. 2. In a corresponding way, the lower working spaces of the right-hand cylinders 14*b*, 15*b* of the respective first and second bogies are interconnected, while these lower working spaces are also interconnected to the upper working spaces of the left-hand cylinders 14*a*, 15*a* of the respective first and second bogies, these interconnections being symbolized by the conduits connected to point 16*b* of FIG. 2. The only existing servo valve 13 controls the tilt of the car body through one connection to 16*a* and a second connection to 16*b*, hence when operating the servo valve by pressing a fluid to one of the connections 16*a* or 16*b* forcing all said hydraulic cylinders of the two bogies to cooperate in order to tilt the body through a coordinated rotational movement.

By the use of one single servo valve 13 (see FIG. 2), the hydraulic cylinders 14*a*, 14*b* and 15*a*, 15*b*, respectively, of the two bogies are controlled in parallel. As will be seen, the hydraulic cylinders are also arranged to communicate (see the hydraulic connections 16*a*, 16*b*). 14*a* and 15*a* are, for example, interconnected and the pressure difference between them will be rapidly equalized.

Figure 3:
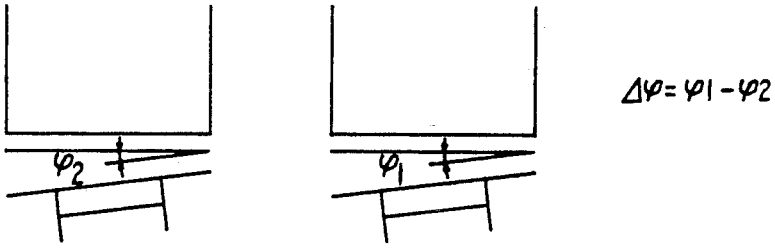
FIG. 3 shows the tilt ratio for two bogies associated with a vehicle.

The angular difference that may arise between bogie 1 and bogie 2 in a vehicle (see FIG. 3, $\Delta\phi=\phi_1-\phi_2$) is controlled by the geometry of the superelevation.

The difference in tilting angle between different bogies belonging to a car is adapted to be measured, the measured signal thus indicating transition curves.

Both the time or space rate of change of the superelevation and the lateral acceleration are adapted to be measured in the vehicle. Upon multiplication of $d_{acc}/d_t$ and $d_{re}/d_t$, a correlation signal is obtained. A positive value indicates a transition curve whereas low or negative values indicate a straight track, a circular track or a track fault. It is desirable to obtain a rapid indication of the lateral acceleration, which deviates as little as possible from the ideal. Normally, the signals to the different control systems are filtered to eliminate disturbance, noise etc. When a track fault occurs, a deviation from the ideal curve takes place, and the degree of filtering can thereby be adjusted (upwards). This is an example of how to use a correlation signal.

Figures 4A, 4B, 4C, 4D, 4E:
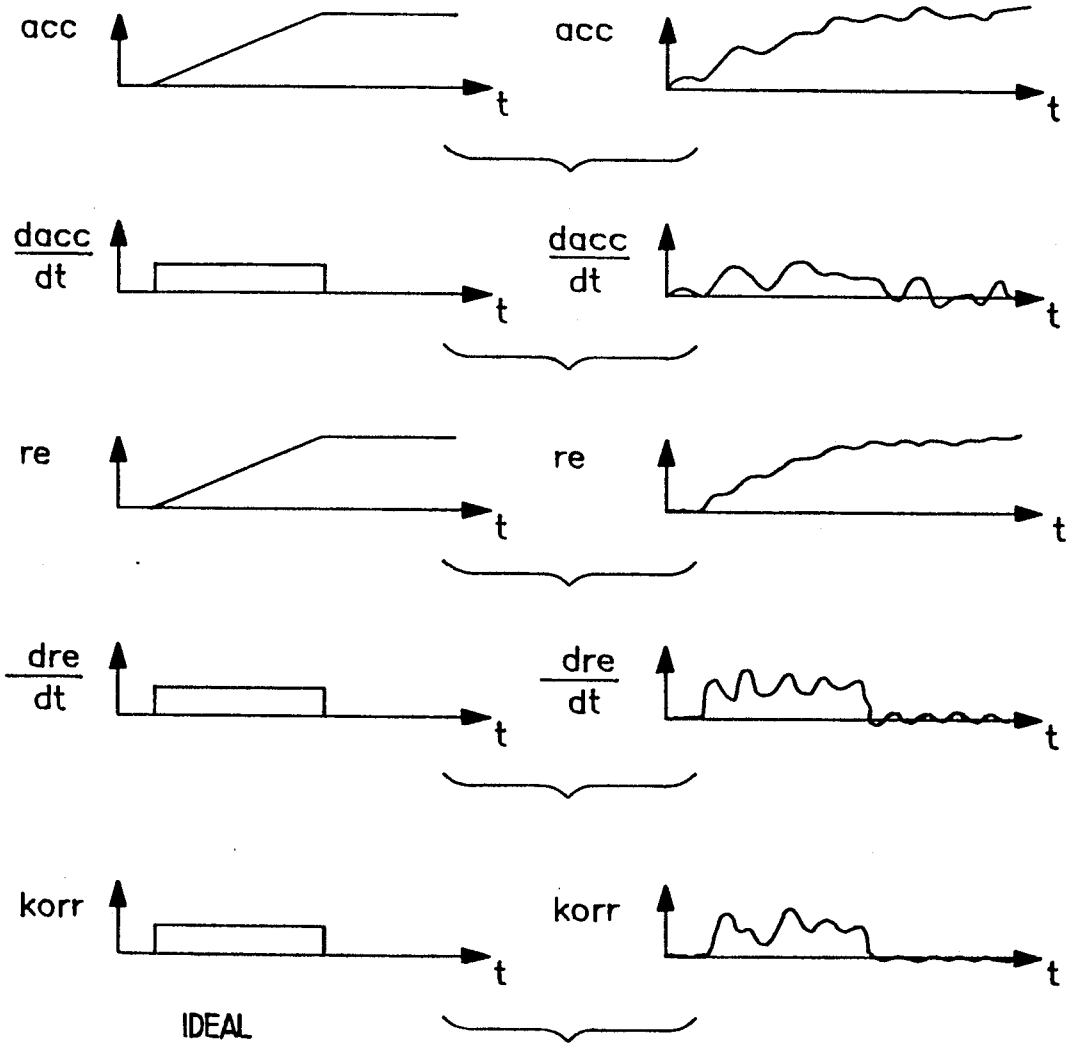
FIGS. 4*a–e* show curves for indication of transition curves.
Figure 5:
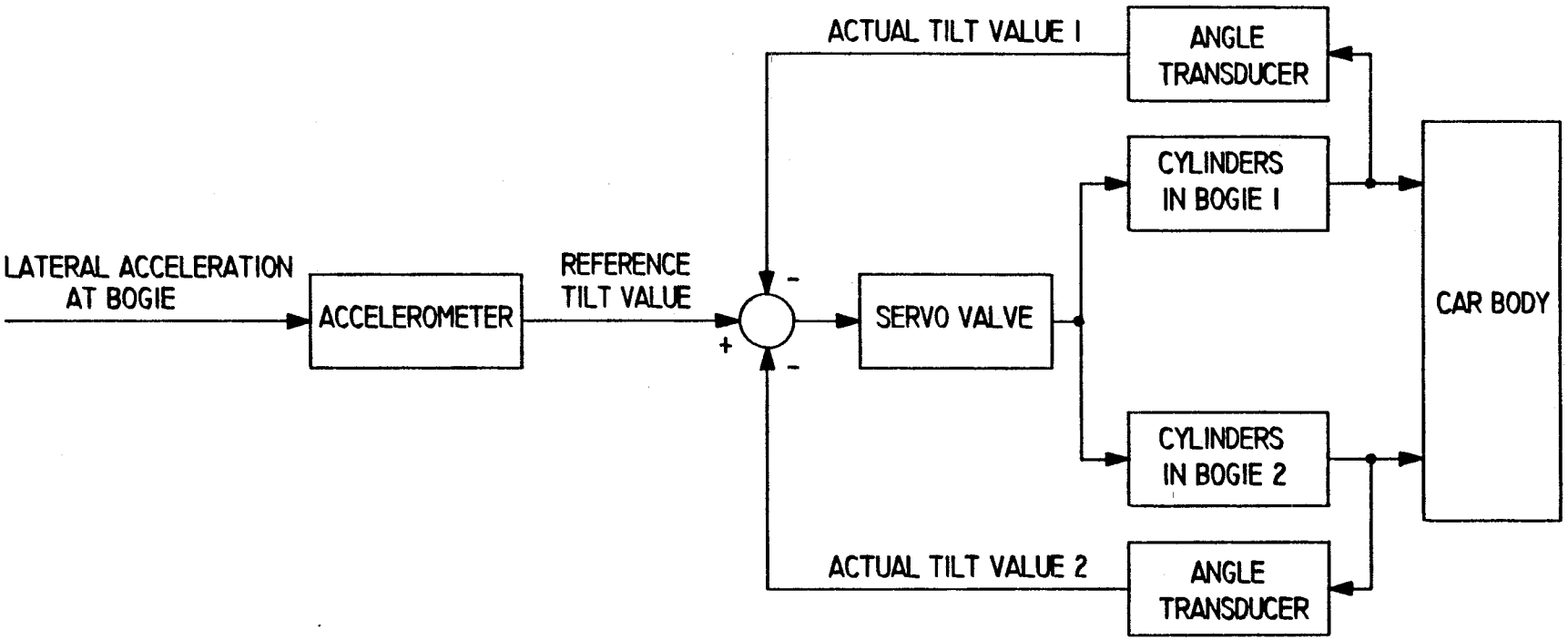
FIGS. 5–10 depict alternative means for controlling the servo valve in the inventive arrangement for controlling the tilting of a railway vehicle.
Figure 6:
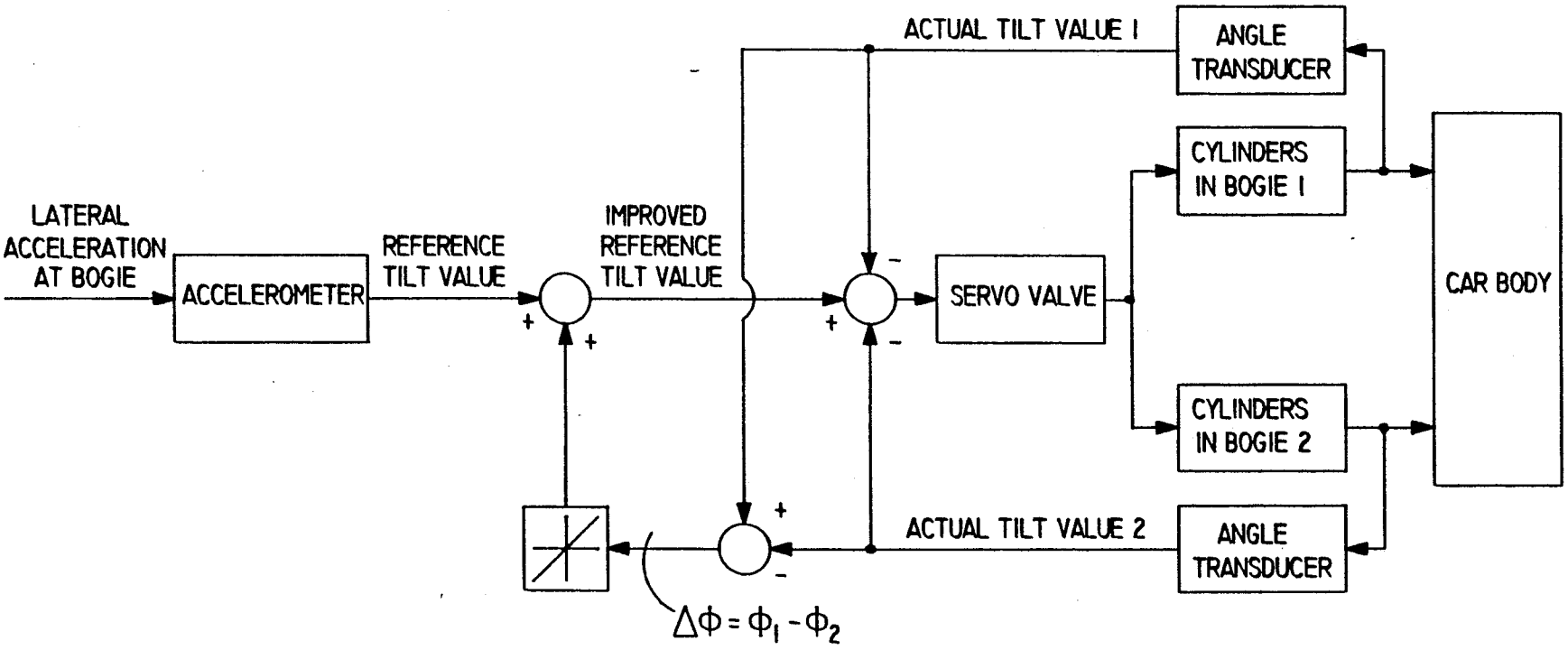
Figure 7:
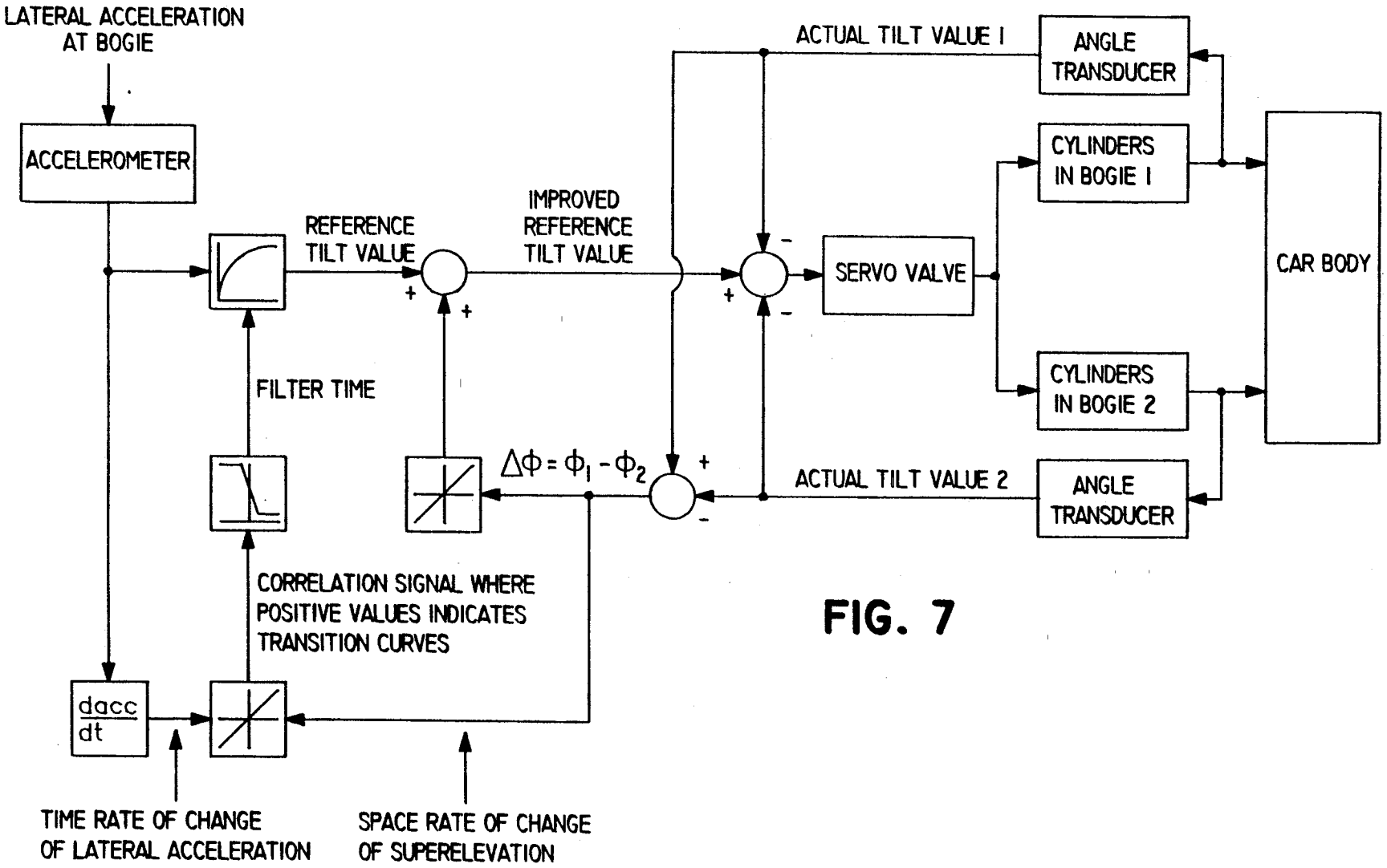
Figure 8:
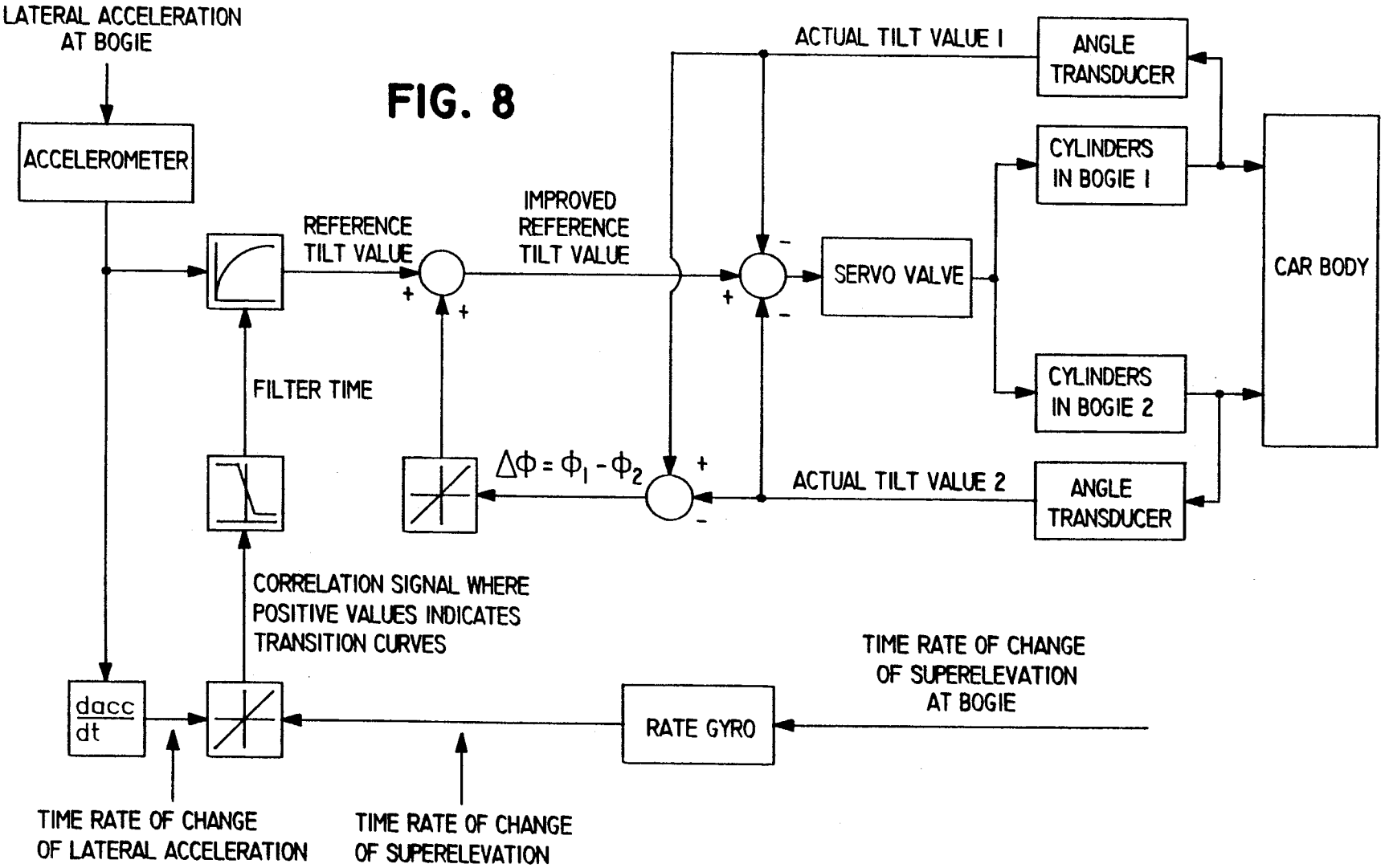
Figure 9:
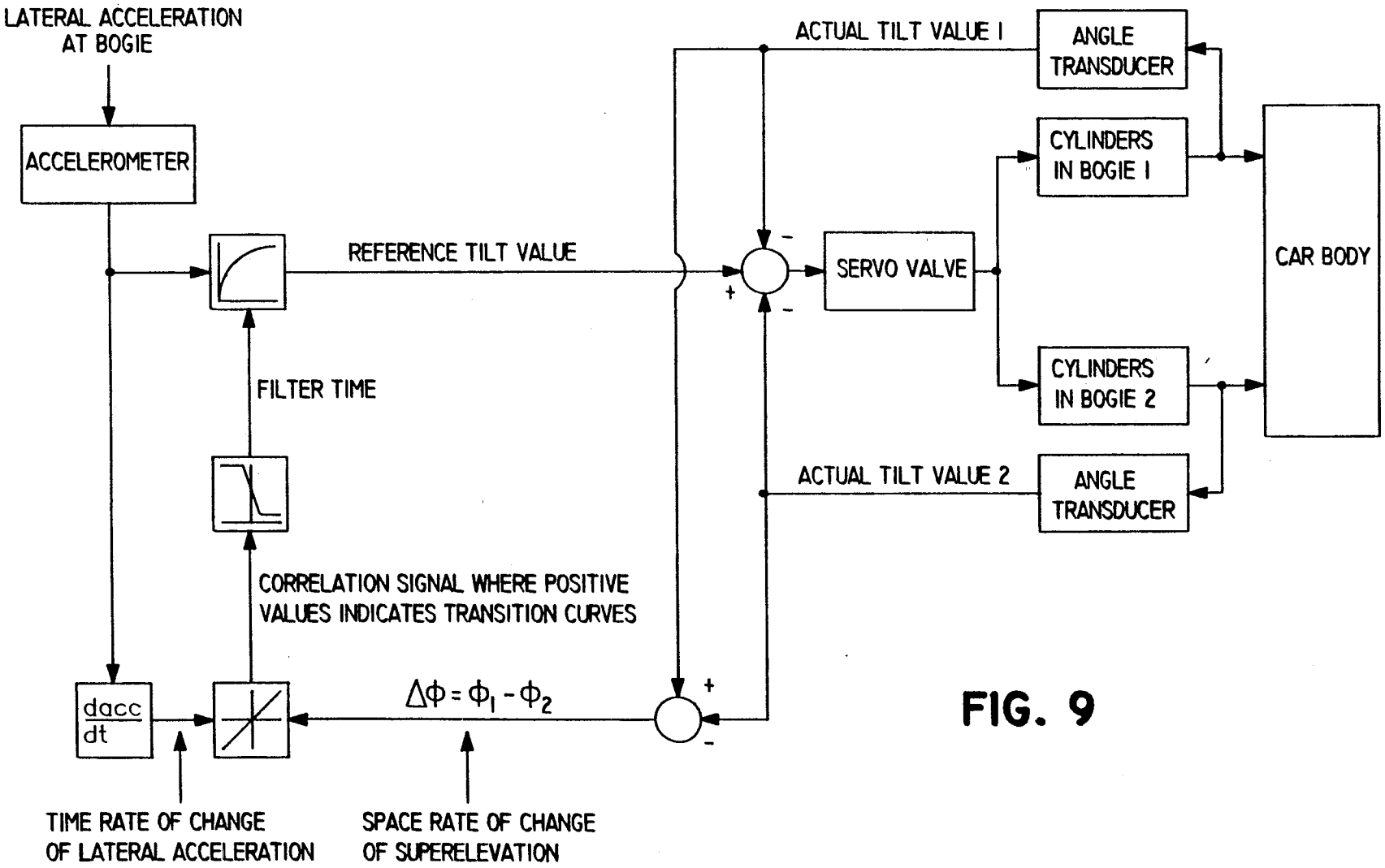
Figure 10:
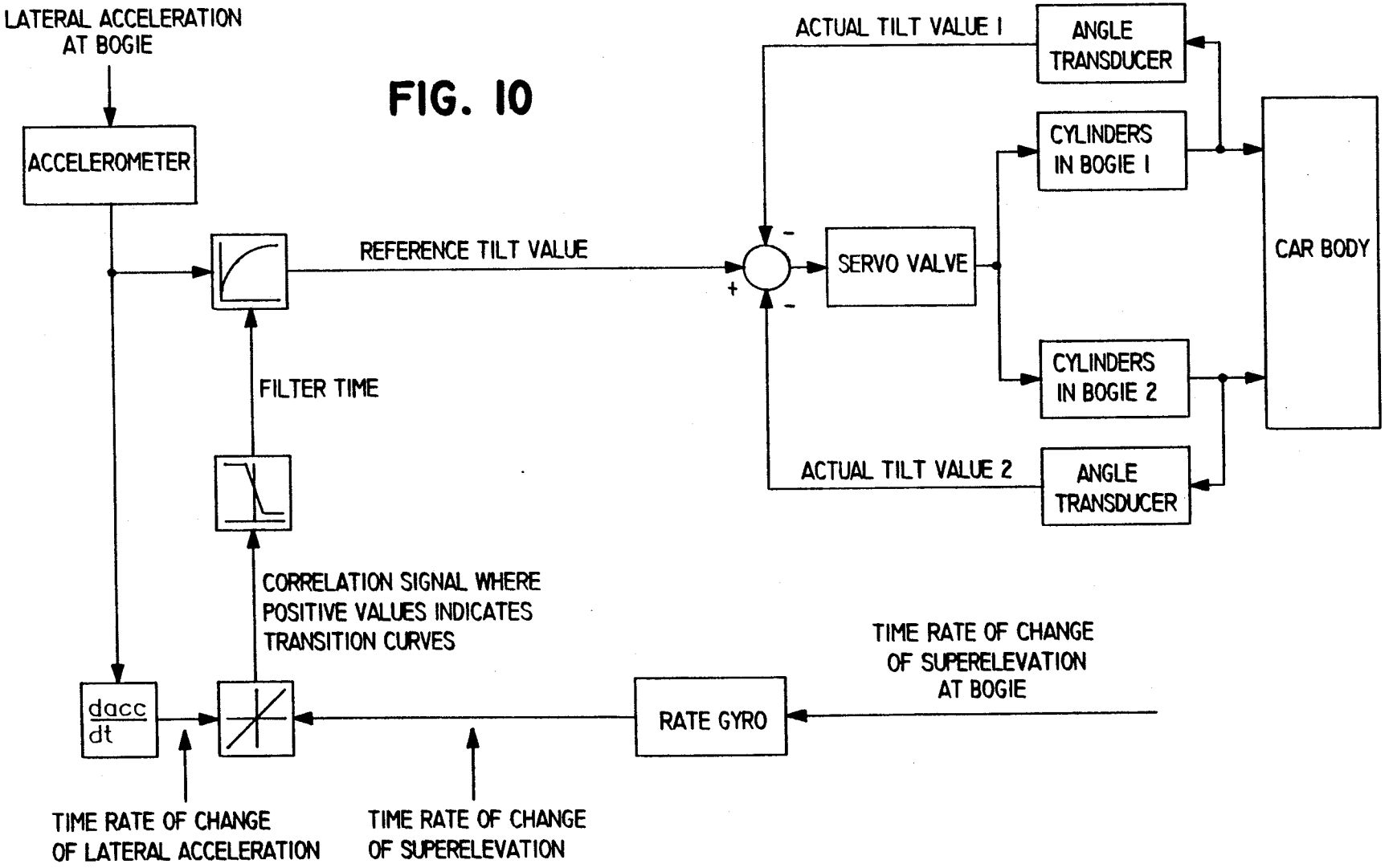

FIG. 4*a* shows the acceleration signals, both the ideal and the actual, when entering a transition curve. FIG. 4*b* shows the time rate of change $d_{acc}/d_t$. FIG. 4*c* shows the superelevation (re) and FIG. 4*d* shows the time rate of change thereof, $d_{re}/d_t$. It is also possible to measure its space rate of change, for example by using the above-mentioned angular difference $\Delta\phi$. The ideal and actual correlation signal is shown in FIG. 4*e*.

In a vehicle with tilting of the car body, the desired value of the tilting is normally formed taking into account the lateral acceleration according to the above. To avoid a large tilting movement, this is normally limited to a maximum value. Under winter conditions, snow which is packed between the movable parts of the tilting system may prevent the tilting movement, which, in turn, may lead to unfavourable wheel unloads and uncomfortable ride. In the case of such snow packing, great angular differences, control errors and forces will arise in the servo system. One or several of these quantities may be utilized for indicating the presence of snow packing, for indicating the degree of snow packing as well as for minimizing the risk of wheel unload.

The angular difference is measured according to the above. The control error is formed as the difference between the actual value and the desired value whereas the forces may be measured, for example, as the difference in hydraulic pressure across the cylinders.

By indicating when the quantity exceeds an expected normal threshold value and then measuring the current tilt angle, a measure of the degree of snow packing is obtained. By adapting the maximum limit of the desired value and hence the tilt angle immediately after the indication, so that the indication ceases, the risk of wheel unload is minimized while at the same time obtaining an indication of the degree of snow packing.

The means according to the above can be varied in many ways within the scope of the following claims.

We claim:

1. Arrangement on a railbound vehicle comprising a car body, at least first and second bogies and at least one hydraulic cylinder mounted at each side of each bogie, each said cylinder including a lower working space and an upper working space and each said cylinder being attached at its lower end to the bogie side and at its upper end to the car body for tilting the car body in track curves, and includes first interconnection means for communicating the lower working spaces of left-handed cylinders of the respective first and second bogies and second interconnection means for communicating said lower working spaces of said left-hand cylinders with the upper working spaces of right-hand cylinders of the respective first and second bogies, said first and second interconnection means forming a first freely communicating conduit system, third interconnection means for communicating the lower working spaces of said right-hand cylinders of the respective first and second bogies and fourth interconnection means for communicating said lower working spaces of said right-hand cylinders with the upper working spaces of said left-hand cylinders of the respective first and second bogies, said third and fourth interconnection means forming a second communicating conduit system, and a single servo valve connected to said first and second communicating conduit systems to control the tilt of the car body by forcing all of said hydraulic cylinders of the vehicle to cooperate in order to tilt the car body through a coordinated rotational movement.

2. Arrangement according to claim 1, further comprising means for measuring lateral acceleration of at least one of the bogies of the vehicle, said means for measuring lateral acceleration producing a control signal for controlling the single servo valve.

3. Arrangement according to claim 1, further comprising means for measuring the tilt angle of said at least first and second bogies and means for determining a difference in said measured tilt angles, and for providing a control signal for said single servo valve which reflects a transition curve in the track.

4. Arrangement according to claim 3, further comprising means for measuring both the time or space rate of change of superelevation and lateral acceleration of the vehicle, means for correlating the time rate of change of lateral acceleration and the time or space rate of change of superelevation and providing a correlation signal reflecting transition curves in the track, said correlation signal controlling a filtering of measured quantities used to provide said control signal.

5. Arrangement according to claim 1, further comprising means for measuring both the time or space rate of change of superelevation and lateral acceleration of the vehicle, means for correlating the time rate of change of lateral acceleration and the time or space rate of change of superelevation and providing a correlation signal reflecting transition curves in the track, said correlation signal controlling a filtering of measured quantities used to provide a control signal.

* * * * *